United States Patent [19]

Carren et al.

[11] 4,331,252

[45] May 25, 1982

[54] MODULAR STORAGE TANK

[75] Inventors: Thomas G. Carren; Asher B. Etkes, both of New York, N.Y.

[73] Assignee: ModuTank, Inc., Long Island City, N.Y.

[21] Appl. No.: 172,130

[22] Filed: Jul. 25, 1980

[51] Int. Cl.[3] ..... B65D 6/24; B65D 6/34; B65D 25/16

[52] U.S. Cl. ..... 220/5 A; 220/71; 220/84; 220/404; 220/461

[58] Field of Search ..... 220/5 A, 71, 75, 80, 220/460, 461, 404, 403, 84, 1 B; 52/282, 584

[56] References Cited

U.S. PATENT DOCUMENTS

| | | | |
|---|---|---|---|
| 234,186 | 11/1880 | Hendrick | 220/75 X |
| 730,344 | 6/1903 | Clayton, Sr. | 220/71 X |
| 1,073,871 | 9/1913 | Sillman | 220/5 A |
| 1,789,102 | 1/1931 | Jorgensen | 52/282 X |
| 3,327,883 | 6/1967 | Buhler | 220/5 A |
| 3,382,625 | 5/1968 | Kuss | 220/84 |
| 3,409,916 | 11/1968 | Billis et al. | 220/71 X |
| 3,460,704 | 8/1969 | Moore et al. | 220/5 A |
| 3,712,139 | 1/1973 | Harvey | 220/71 X |

*Primary Examiner*—Allan N. Shoap

[57] ABSTRACT

A prefabricated modular storage tank particularly suitable for the containment of liquids wherein frame members of uniform length may be fitted and bolted together on site, the frame members together with cross tensioning means operating to support and contain the hydrostatic load imposed upon thin gauged sheet metal panels which in turn contain and support a liquid impervious liner.

6 Claims, 13 Drawing Figures

MODULAR STORAGE TANK

BACKGROUND OF THE INVENTION

This invention relates generally to storage tanks of the type designed to contain liquids of different specific gravities and more specifically to a prefabricated modular construction of such tanks in a unique manner to minimize the use of materials, to optimize shipping of uniformly sized parts used in the integrated tank structure and to facilitate on site erection of the novel modular storage tank. The use of prefabricated modular construction to contain large quantities of liquid is generally known; for example, above-ground swimming pools employ this technique. However, the methods used have inherent deficiencies or limitations with respect to the containment of a liquid beyond relative shallow depths, for example, four to five feet. In fact, to contain liquids even at these depths, it has been found necessary to provide laterally extending reinforcing members or struts in conjunction with each vertical frame member. To contain even greater depths would necessarily increase the complexity, expense and weight of these frame members.

The present invention seeks to advance the state of the art in the construction of modular storage tanks for the containment of liquids of various types and at heights of containment of say up to eight feet. The principal object is to produce a tank of modular construction which inherently can be made small or large by the simple inclusion or exclusion of modular units and which is so designed as to greatly minimize the amount of material needed to safely contain large quantities of liquid for commercial purposes. The technique employed adapts certain of the known prior techniques used in the construction of swimming pools in that rigid, vertical and horizontal frame members are employed to reinforce sheet metal panels which in turn contain and reinforce a liquid impervious flexible liner. However, the storage tank of the present invention utilizes frame members designed specifically to withstand the hydrostatic pressure of heights of say six to eight feet and moreover incorporates the use of cross tensioning members to counteract lateral pressure of the contained liquid. Although some forms of containers or enclosures, for example, those illustrated in U.S. Pat. Nos. 1,293,549, 3,382,625 and German Pat. No. 2,048,383, have been known to utilize cross tensioning members for reinforcing, the integration of such tensioning members in conjunction with the other design features of the present invention are believed to be quite unique. It is in fact an aspect of the present invention that the modular tank disclosed herein uses structural material so efficiently that the tank itself would not be permanently freestanding and able to withstand wind loads without the rigidifying effect of the contained liquid. In other words, the structure which is disclosed herein has been designed specifically with the concept of utilizing opposite counteracting forces of hydrostatic pressure and tension. The foregoing aspects will be more completely understood and appreciated upon examination of the specification and drawing which follows:

SUMMARY OF THE INVENTION

In accordance with the present invention, a rectangular storage tank for the containment of liquids and the like has been devised, the tank comprising a plurality of elongated upright frame members arranged to form a quadrilateral; top, bottom and center horizontally disposed rail members secured to said upright frame members to define discrete modular sections formed by and intermediate two adjacent upright frame members, wall panels of thin-gauged sheet metal, means for securing the ends of said panels to adjacent ones of said upright frame members, a flexible, liquid-impervious liner arranged internally of and depending from said wall panels and cable tensioning means attached to top and bottom portions of said upright frame members, said cable tensioning means extending perpendicularly from one wall and across the interior of said tank to top and bottom portions of an upright frame member located in an opposite wall of said tank, whereby sideward hydrostatic loads upon the walls of said tank from a contained liquid may be selectively compensated. More particularly, the upright frame members are respectively arranged at the four corners and at uniformly spaced distances in each wall, the upright frame members being made of built-up or laminated angles of L-shaped cross section, the wall panels including a vertical flange along each vertical edge which is received by the respective legs of the angles which are then bolted together to hold the wall panels in place, thus frictionally securing the ends of the wall panels. The cable tensioning means is arranged in line with the laminated doubled portions of the posts.

DESCRIPTION OF A PARTICULAR EMBODIMENT

Figure 1:
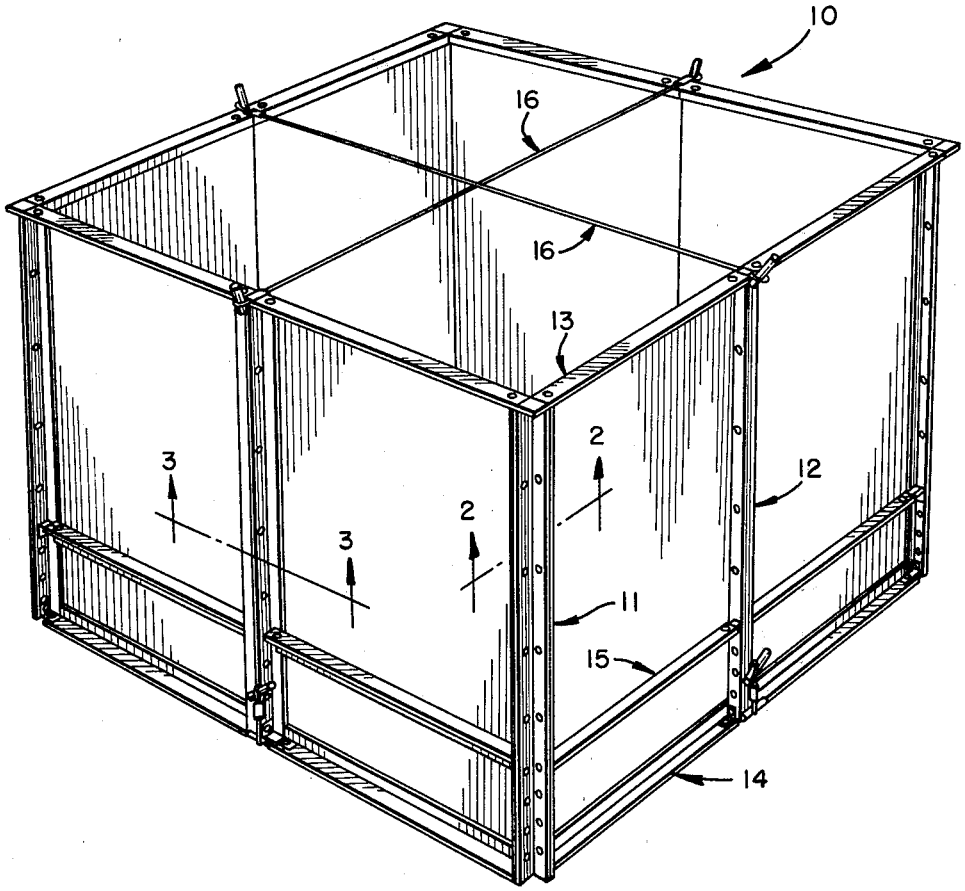
FIG. 1 is a perspective view of a prefabricated modular storage tank constructed in accordance with the principles of the present invention.

Referring now to the drawing and initially to FIG. 1 thereof, a tank 10 constructed according to the principles of the present invention has been illustrated. The tank 10 includes built up corner posts 11, side wall posts 12, top and bottom rails 13, 14 and center or intermediate rail 15. Top cross tension members 16 have been shown in FIG. 1; however, bottom cross tension members will be described in connection with certain of the detailed drawings.

Figure 2:
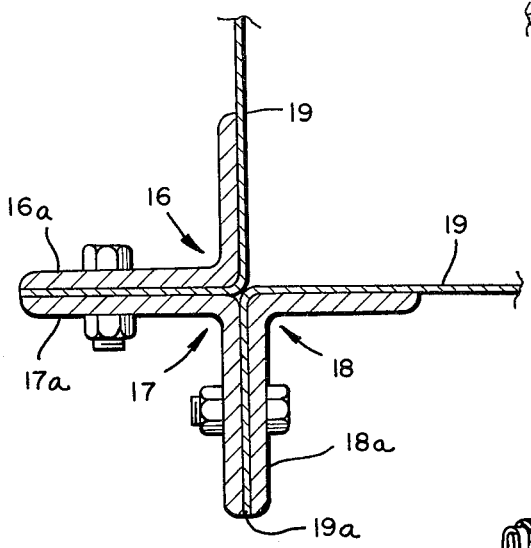
FIG. 2 is a horizontal cross section taken in the direction of arrows 2—2 of FIG. 1.

FIG. 2 is a horizontal cross section through a typical vertical corner post. The corner post is built up of three steel angles 16–18. Thin gauged sheet steel wall panels 19 are formed to have vertical end flanges 19*a* which are sandwiched respectively between adjacent legs 16*a*, 17*a* and 17*a*, 18*b* of angles 16–18. These are bolted securely together to engage and hold the flanges 19*a* and form an X-shaped cross section and a corner or 90° interior angle. It will be noted that the doubling of the steel angle legs forms a very strong and rigid built up corner post wherein the doubling up of the legs occurs as a continuation of each wall of the tank. This provides great rigidity and strength at the corners in two perpendicular directions.

Figure 3:
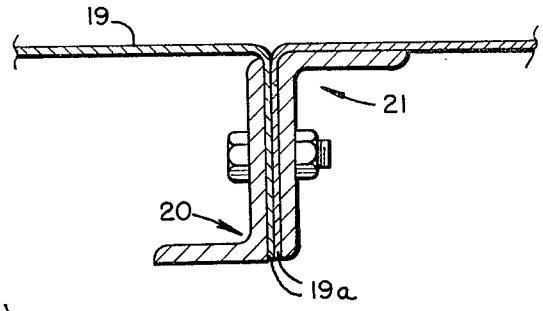
FIG. 3 is a horizontal cross section taken in the direction of arrows 3—3 of FIG. 1.

FIG. 3 illustrates the typical construction of a vertical center post. Each post comprises two angles 20, 21 arranged in the form of a "Z" with the doubled together bolted legs sandwiching therebetween end sections 19*a* of adjacent wall panels 19, thus securing the end sections frictionally in an overall manner. Even though the end sections are held by bolts, sandwiching of them between the legs of the angles protects against tearing of the end sections vis-a-vis the attach bolts. Also, from a structural standpoint, in its ability to resist horizontal loads, the "Z" composite construction is superior to an alternative "T" construction which might have been chosen.

Figure 4:
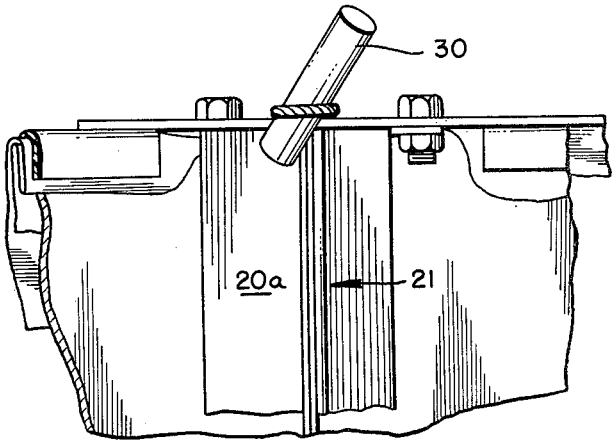
FIG. 4 is a partial side elevation of a section of the tank of FIG. 1 illustrating the juxtaposition of vertical frame members and adjacent panel sections.
Figure 6:
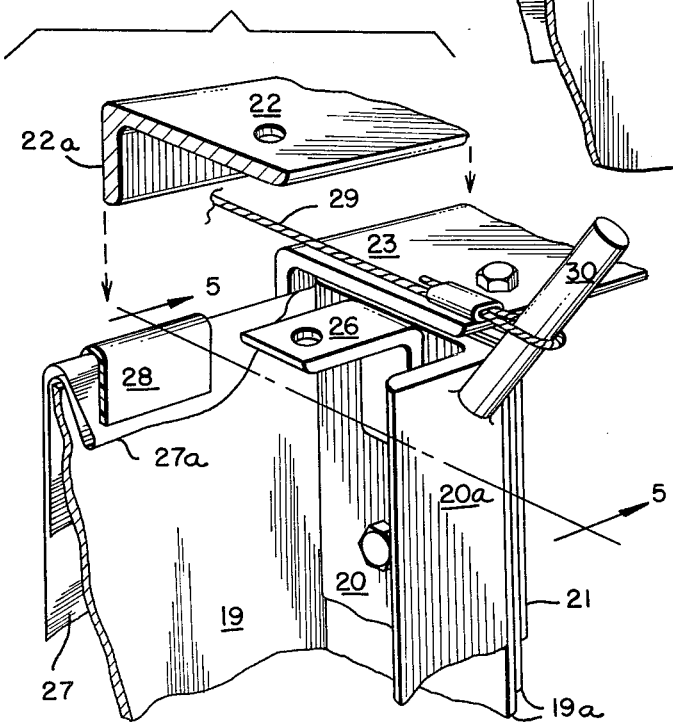
FIG. 6 is a perspective view with certain parts broken away and exploded illustrating the members shown in FIG. 4 from a position taken slightly above and along one wall of the storage tank.
Figure 5:
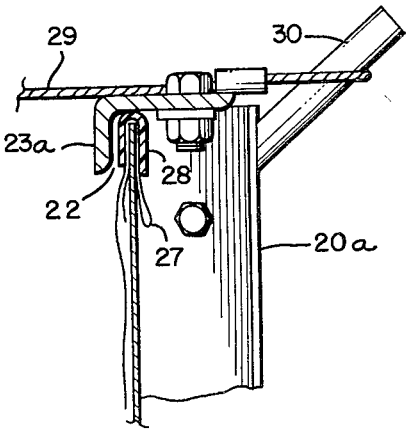
FIG. 5 is a cross section taken in the direction of arrows 5—5 of FIG. 6.

FIGS. 4–6 illustrate upper portions of a vertical center post and the integration therewith of a top rail 13, a tensioning cable and means for securing the cable to a vertical center post. The top rail consists of angles 22, 23 which are bolted to the doubled or sandwiched legs 20*a*, 21*a* of angles 20, 21 by the use of intermediate brackets 26. A plastic liner 27 is arranged as indicated in FIG. 6 with portions 27*a* thereof doubled over the top of the wall panels 19. A plastic liner lock extrusion 28 secures the doubled over portion 27*a* to the steel wall panel 19.

The end of a steel tensioning cable 29 is looped about a cable mounting post 30, and it will be understood that each end of the cable 29 is thus secured at opposite sides of the tank 10 to a cable mounting post 30. As best seen in FIG. 4, the post 30 is welded to the upper end of angle leg 20*a* forming part of the vertical center post and is angled such that the center line of cable 29 will approximate the center of the juncture between steel angles 20 and 21. In other words, the forces applied by the cable when it is properly placed in tension will be applied directly along the doubled section of the vertical center post. This prevents warping or twisting of the center post and applies the cable tension where it is most able to receive it. It is further noted that with respect to FIG. 5, the post 30 is angled away from the wall of the tank as well. Thus, when the cable ends are looped over posts 30, and the liquid fills the tank, it is virtually impossible for the cables to slip off the posts 30. For installation purposes, cables 29 will be sized as to length precisely for a particular application, and the vertical member to which the cable is attached will be deflected inwardly to allow looping of the cable end over its mounting post.

Figure 9:
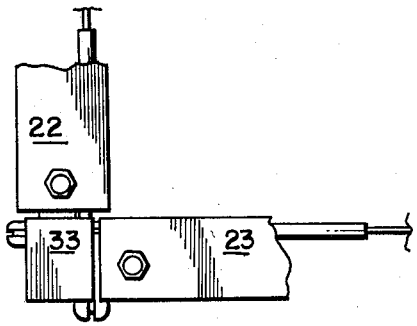
FIGS. 9 and 10 are respectively top and perspective views of a typical corner section.
Figure 10:
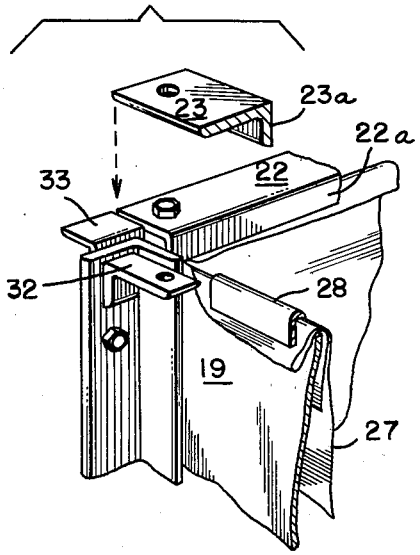

FIGS. 9 and 10 illustrate the integration of the corner post 11, angles 22 and 23 forming the top rail, and the liner 27. Legs 22*a* and 23*a* of the top rails depend beyond the upper edge of the wall panels 19 forming a groove 22 for the reception and retention of the upper end 27*a* of the liner. Angles 22 and 23 are bolted to mounting brackets 32 which are secured to the doubled vertical section of the steel angles 16–18. A corner cap 33 is also attached to the top of the outside corner formed by the angles 16–18.

Figure 7:
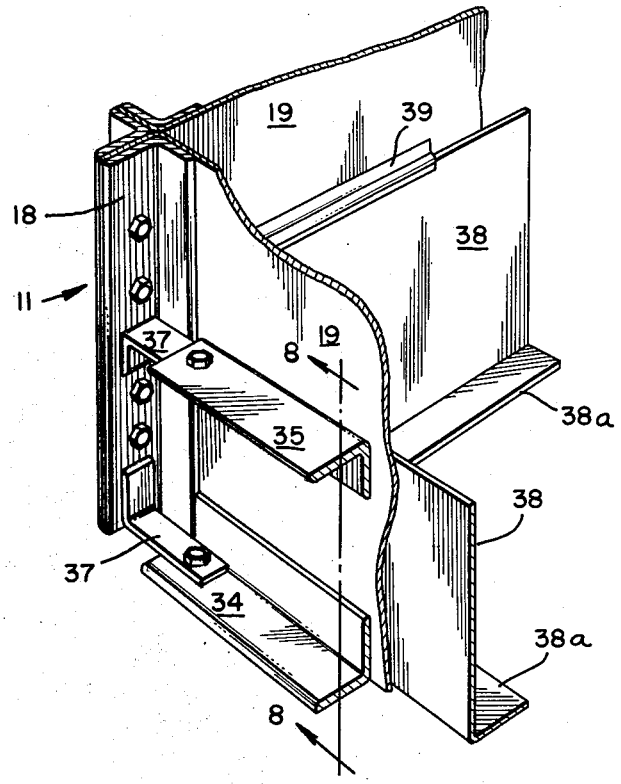
FIG. 7 is a perspective view partially broken away of a bottom corner section of the tank shown in FIG. 1.
Figure 8:
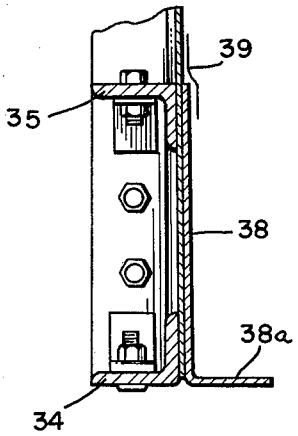
FIG. 8 is a vertical cross section taken in the direction of arrows 8—8 of FIG. 7.

Referring to FIGS. 7 and 8, the bottom section of a tank corner has been illustrated and contains, in addition to the corner post 11 which has been previously described, bottom rails 34 and a center rail 35, each of which as shown is secured to a doubled section of the corner post by the use of intermediate brackets 37. In addition, immediately inside of the wall panels 19, reinforcing/adjustor wall panels 38 are placed having at the bottom a flange 38*a* whose function is to prevent extrusion of the liner (not shown in this figure) beneath the wall of the tank. Similarly, tape 39 is placed over the upper edge of the reinforcing/adjustor wall panel to prevent possible cutting or extrusion of the liner at the juncture between the upper edge of members 38 and the wall panels 19. It will be understood that a plurality of reinforcing/adjustor wall panels 38 will be used to reinforce panels 19 and that these will be placed up against wall panels 19 in a vertically overlapping manner. The height of the wall panels 38 shall be the height from the bottom of the tank of the center rail. The center rail is placed approximately at one-third of the total height of the tank which has been determined to be the position of greatest stress due to hydrostatic pressure.

Figure 11:
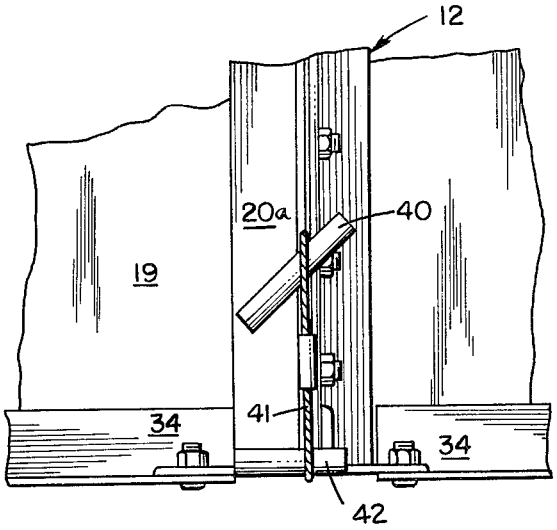
FIG. 11 is a partial elevation of a bottom cable mounting post on a center vertical reinforcing column.
Figure 12:
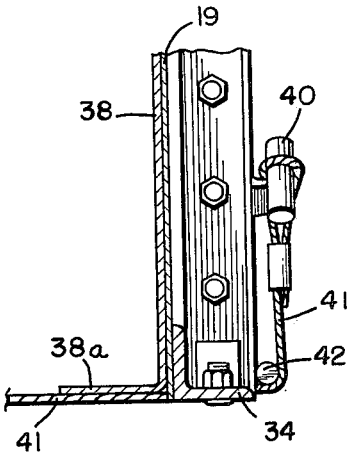
FIGS. 12 and 13 are respectively vertical sections and perspective views of the structure shown in FIG. 11.
Figure 13:
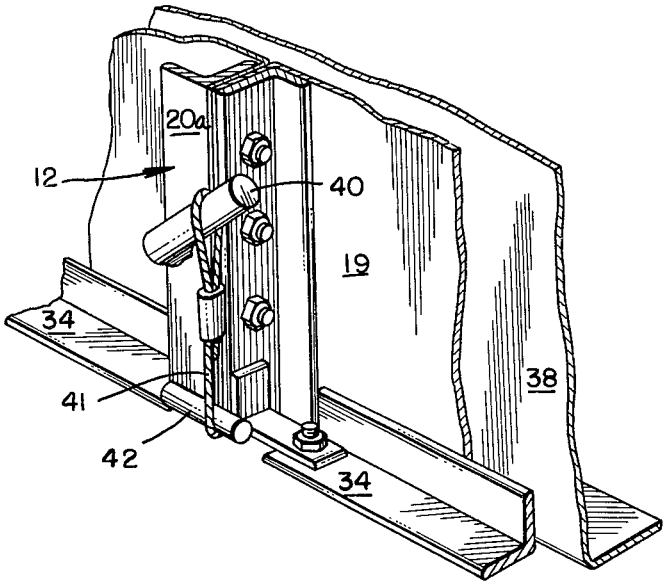

Referring now to FIGS. 11–13, a typical vertical center post 12 has been illustrated with adjacent bottom rails 34 attached thereto by means of intermediate brackets 37. Welded to section 20*a* of the "Z" section center post is an upper cable mounting post 40 whose function is to secure the looped-over end section of cable tensioning member 41. Cable tensioning member 41 will pass over a direction changing bottom post 42 which is also welded to the outer face of section 20*a*, the bottom post 42 being raised sufficiently above the bottom rails 34 to provide a groove or clearance for the passage of cable 42. It will be understood that the opposing wall of the tank will be equipped with similar mounting arrangements, and by this means, tension may be applied directly across the interior portions of the tank 10. As best see in FIG. 4, the upper mounting post 30 is placed at an angle so that the cable 41 will be aligned with the center line of the doubled over section of a center post for reasons which have previously been made clear.

Having described the detailed construction of the tank of the present invention, it will be understood that the tank is actually composed of separate, uniformly sized members, and thus the tank may be made practically any length or width with only the liner and cables being sized for the resultant dimensions. Basically, each module consists of a wall panel 19 which, for example, will be four feet wide and six to eight feet long. Backing each wall panel will be top, center and bottom rails which are generally of the same width as each wall panel and which are joined in modular form to vertical posts of either the corner or center post construction. It is obvious that although FIG. 1 has illustrated the use of only one center post, many may be arranged to extend the length or width of the tank. As mentioned, the center rail is placed approximately at a height of one-third of the total height from the ground or bottom of the tank which is the position required to best resist the vertical hydrostatic load since such load diminishes with height vis-a-vis the side walls of the tank, and the reinforcing/adjustor panels 38 are placed against wall panels 19 throughout this area.

It should be noted that because of the modular construction, all of the frame members consisting of the various steel angles making up the corner posts and center vertical posts, the top, bottom and center rails are easily nested and packaged for shipping while the wall panels easily lie flat for shipment. The design lends itself to making the frame members and wall panels as strong as is necessary to contain a given height and specific gravity of liquid. As mentioned previously, the use of the cross tensioning members permits minimization of the use of material in the walls with respect of the elements of the frame. Furthermore, the relationship of the frame and side wall construction in combination with the upper and lower cross tensioning members is such that great rigidity results when the liquid is contained. This aspect of utilizing the counteracting forces of hydrostatic pressure and cross tension to provide great strength and rigidity is unique.

It will be understood that the foregoing description has been of a particular embodiment of the invention and is therefore representative. In order to understand more fully the nature and scopy of the invention, reference should be made to the appended claims.

We claim:

1. A rectangular storage tank for the containment of liquids and the like comprising a plurality of elongated upright frame members arranged to form a quadrilateral; top, bottom and intermediate horizontally disposed rail members secured to said upright frame members to define discrete modular sections formed by and intermediate two adjacent upright frame members, wall panels of thin gauge sheet metal, means for securing the ends of said panels to adjacent ones of said upright frame members to form a wall structure between said frame members, a flexible liquid-impervious liner internally of and depending from said wall panels, supplementing reinforcing/adjustor wall panels across the bottom of said wall panels up to the height of the intermediate rail members, said intermediate rail members being arranged at a height of approximately one-third of the total height of the tank, said supplementary reinforcing/adjustor wall panels being provided with inwardly facing horizontal flanges at the bottom thereof to prevent extrusion of the liner beneath said wall panels, cable tensioning means attached to top and bottom portions of said upright frame members, said cable tensioning means extending perpendicularly from one wall structure and across the interior of said tank to top and bottom portions of an upright frame member located in an opposite wall structure of said tank whereby outward hydrostatic loads within said tank from a contained liquid may be selectively compensated.

2. The storage tank according to claim 1 wherein said upright frame members are vertical laminates of steel angles of L-shaped cross section and the ends of said panels are flanges which are sandwiched between two overlapping legs of adjacent L-shaped angles, said legs when bolted together frictionally securing the flanged ends of said panels.

3. The storage tank according to claim 2 wherein corner posts are formed of three members each having two perpendicularly oriented legs, said corner posts having an X-shaped cross section when adjacent legs of said members are fastened together to form two doubled sections which are perpendicular to each other, adjacent wall panels being secured to each corner post by edges thereof being sandwiched between two adjacent legs of said members at right angles to a respective wall panel.

4. The storage tank according to claim 2 wherein vertical center posts are constructed and arranged at spaced intervals intermediate the corners of the tank, each center post being a composite of two members each having two perpendicularly oriented legs, two of said legs being joined to form a double section, each center post being of Z-shaped cross section, adjacent wall panels being secured to each center post by the edges thereof being sandwiched between said double section at right angles to a respective wall panel.

5. The storage tank according to claim 4 wherein cable mounting posts are secured to both upper and lower parts of a vertical center post, each cable mounting post being angled with respect to a vertical outer edge of one of the legs of the respective center post to which each mounting post is attached.

6. The storage tank according to claim 5 wherein means are provided for running the bottom cable beneath the wall of the tank adjacent to the lower edges of bottom rail members.

* * * * *